United States Patent [19]

Waas

[11] 4,428,634

[45] Jan. 31, 1984

[54] CAP SHOES FOR CABLE CONNECTOR

[75] Inventor: Charles W. Waas, Huntington Beach, Calif.

[73] Assignee: Communications Technology Corporation, Los Angeles, Calif.

[21] Appl. No.: 255,328

[22] Filed: Apr. 17, 1981

[51] Int. Cl.[3] ..... H01R 13/635

[52] U.S. Cl. ..... 339/42; 339/45 M; 339/75 M; 339/210 M

[58] Field of Search ..... 339/45 R, 45 M, 75 R, 339/75 M, 91 R, 210 R, 210 M, 42

[56] References Cited

U.S. PATENT DOCUMENTS

| | | | |
|---|---|---|---|
| 3,534,320 | 10/1970 | Rushing | 339/75 M |
| 3,772,635 | 11/1973 | Frey et al. | 339/111 |
| 3,798,587 | 3/1974 | Ellis, Jr. et al. | 339/210 M |
| 4,033,658 | 7/1977 | Asick | 339/210 M |
| 4,138,181 | 2/1979 | Hacker et al. | 339/45 R |
| 4,285,563 | 8/1981 | Crosier et al. | 339/45 M |

*Primary Examiner*—John McQuade

*Attorney, Agent, or Firm*—Harris, Kern, Wallen & Tinsley

[57] ABSTRACT

A cap shoe system for making electrical connections between a plurality of conductors in one cable and a corresponding plurality of conductors in a connector module of a connector which includes an index strip, the connector module, and a cap. The cap has access holes for contact pins carried by the cap shoe which has a slide member that is retractable to provide for entry of the contact pins through the access holes in the cap into electrical contact with the respective conductors in the connector module. The cap shoe body is formed of two molded shell sections with projecting bosses for locating the contact pin housings. The slide member is a unitary molding and carries corresponding adjustable shims and locking clips for engaging the connector module.

8 Claims, 14 Drawing Figures

FIG. 9.
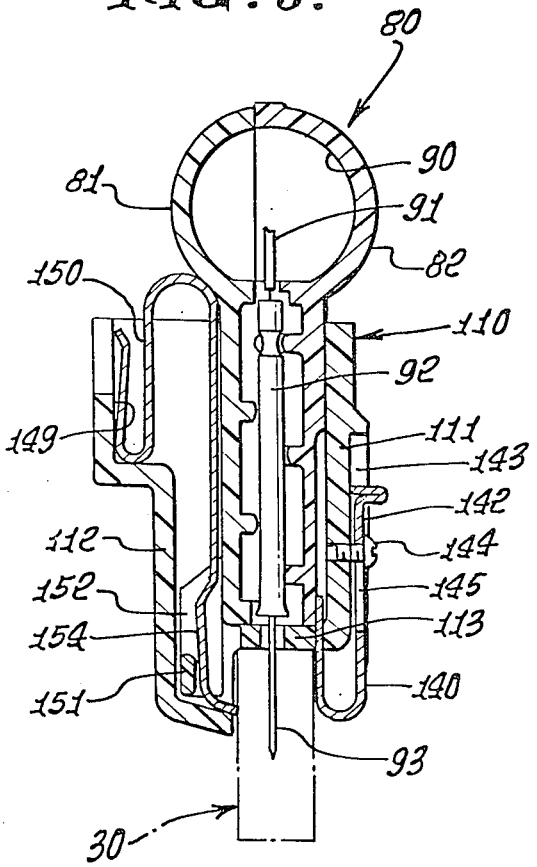
FIG. 10.
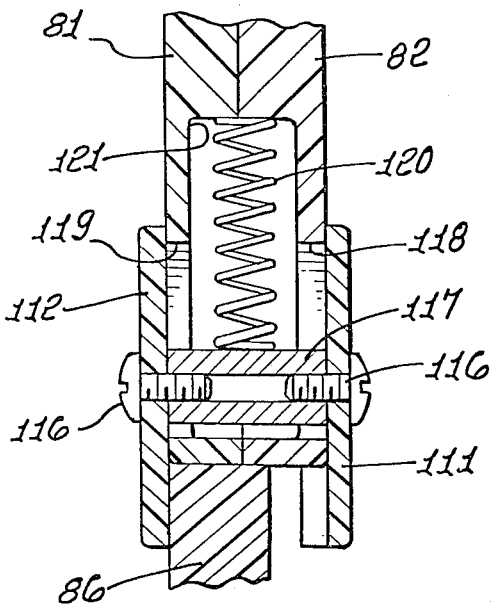
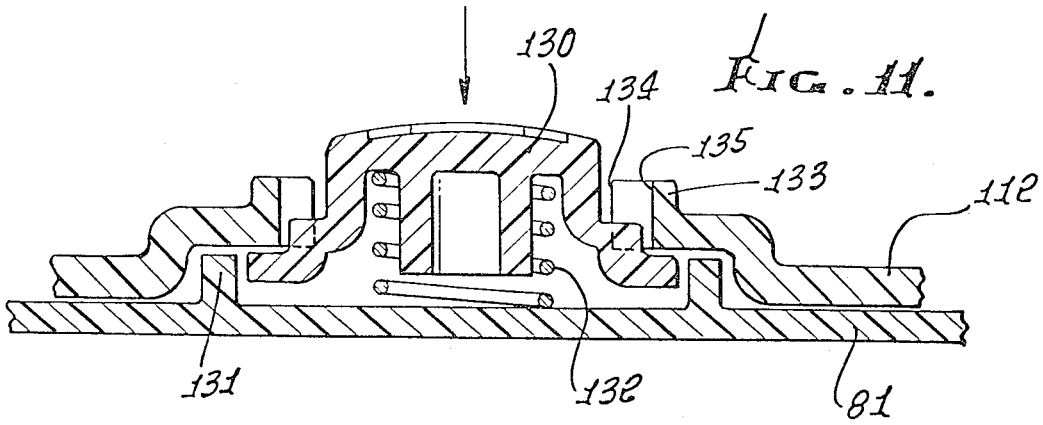
FIG. 11.

CAP SHOES FOR CABLE CONNECTOR

BACKGROUND OF INVENTION

The present invention relates in general to devices, commonly referred to as cap shoes, for making electrical connections between pluralities of conductors in cables and corresponding pluralities of conductors in various conductor-system components, and particularly telephone conductor-system components, such as terminals, connectors, and the like.

More particularly, the present invention relates to shoes for making electrical connections between plurlities of conductors in cables and corresponding pluralities of conductors in connector and/or bridge modules of a connector, commonly known in the telephone industry as a 710 connector, having substantially the structure disclosed in Frey et al, U.S. Pat. No. 3,772,635, granted Nov. 13, 1973. Basically, such a connector includes an index strip, a connector module and a connector-module cap, and may also include a bridge module having a bridge-module cap, each such module being adapted to accommodate, for example, 50 telephone conductors, or the like. As will become apparent, the shoes of the present invention make electrical connections between the respective cable conductors and the corresponding connector-module and bridge-module conductors through the connector-module and bridge-module caps, and, therefore, are referred to herein as cap shoes.

A cap shoe design is shown in the copending application, Ser. No. 060,997, filed July 26, 1979, now U.S. Pat. No. 4,285,563, and assigned to the same assignee as the present application. It is an object of the present invention to provide a new and improved cap shoe which will provide for a simplified production, reduction in cost, and improved operation.

A further object of the invention is to provide such a cap shoe which is particularly adapted for plastic molding manufacturing. An additional object is to provide such a cap shoe wherein the body is formed of two molded shell sections which provide for carrying the contact pins within one of the sections and also provides for removable end arms permitting use of the cap shoe with the connector module and with the bridge module as desired. An additional object is to provide such a new and improved cap shoe design incorporating adjustable shims and permitting use of the cap shoes with various sizes of connectors, and also incorporating a new and improved gripping element for retaining a connector component within a cap shoe.

These and other objects, advantages, features and results will more fully appear in the course of the following description.

SUMMARY OF THE INVENTION

The cap shoe of the invention includes a cap shoe body with an elongate central section having arms projecting from opposite ends forming a U-shaped receptacle for the connector, with the body having front and rear molded shell sections joined together at their ends. The cap shoe also includes a plurality of spring loaded contact pin units carried in a line in the central section of the body between the front and rear sections, with pins insertable through access holes in the cap of the connector. The cap shoe further includes a U-shaped slide member in the form of a unitary molding and mounted on the cap shoe body with the arms of the slide member embracing the body and including an integral elongate spacer berween the arms with openings in a line for the contact pins.

In the preferred embodiment, each of the contact pin units includes an elongate housing with an annular groove, and at least one of the body shell sections includes inwardly projecting spaced bosses defining channels for receiving and positioning the pin unit housings. Additionally, the shell sections of the body provide grooves there between at opposite ends for slidingly receiving pairs of arms adapted for operation with various components of the connector, permitting interchange of arm pairs.

Also in the preferred embodiment, means are provided for gripping a connector component in the cap shoe, comprising a resilient locking clip carried in the slide member and moved into engagement with a connector component when the slide member is moved on the body. Further, an adjustable shim is incorporated in the slide member to permit adjustment of the size of space for receiving the connector component, permitting operation of the cap shoe with various connectors.

BRIEF DESCRIPTION OF THE DRAWINGS

FIG. 9 is an enlarged sectional view taken as indicated by the arrowed line 9—9 of FIG. 4;

FIG. 10 is an enlarged fragmentary sectional view taken as indicated by the arrowed line 10—10 of FIG. 3;

FIG. 11 is an enlarged fragmentary sectional view taken as indicated by the arrowed line 11—11 of FIG. 4;

DESCRIPTION OF THE PREFERRED EMBODIMENT

Connector-Module Cap Shoe, FIGS. 1–11

Figure 1:
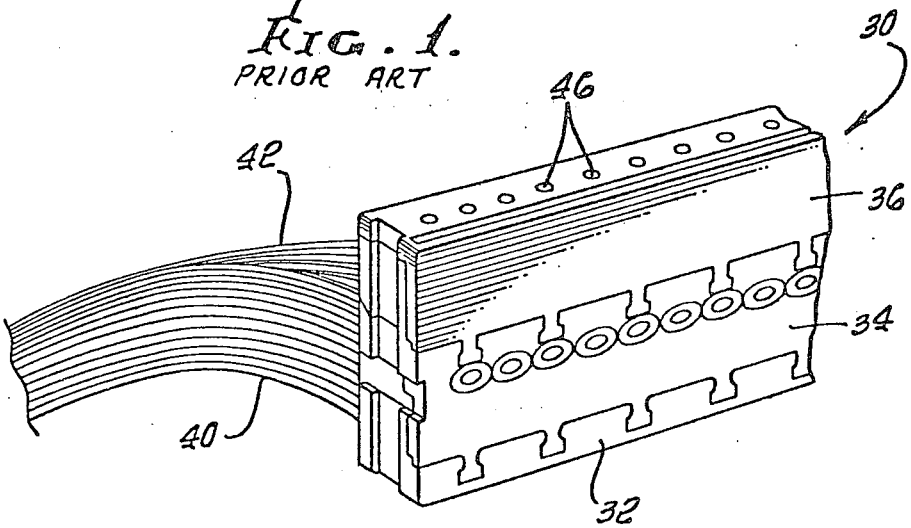
FIG. 1. PRIOR ART
FIG. 1 is a fragmentary perspective view of a so-called 710 connector substantially as disclosed in the aforementioned Frey et al patent, and including an index strip, a connector module and a connector-module cap.
Figure 2:
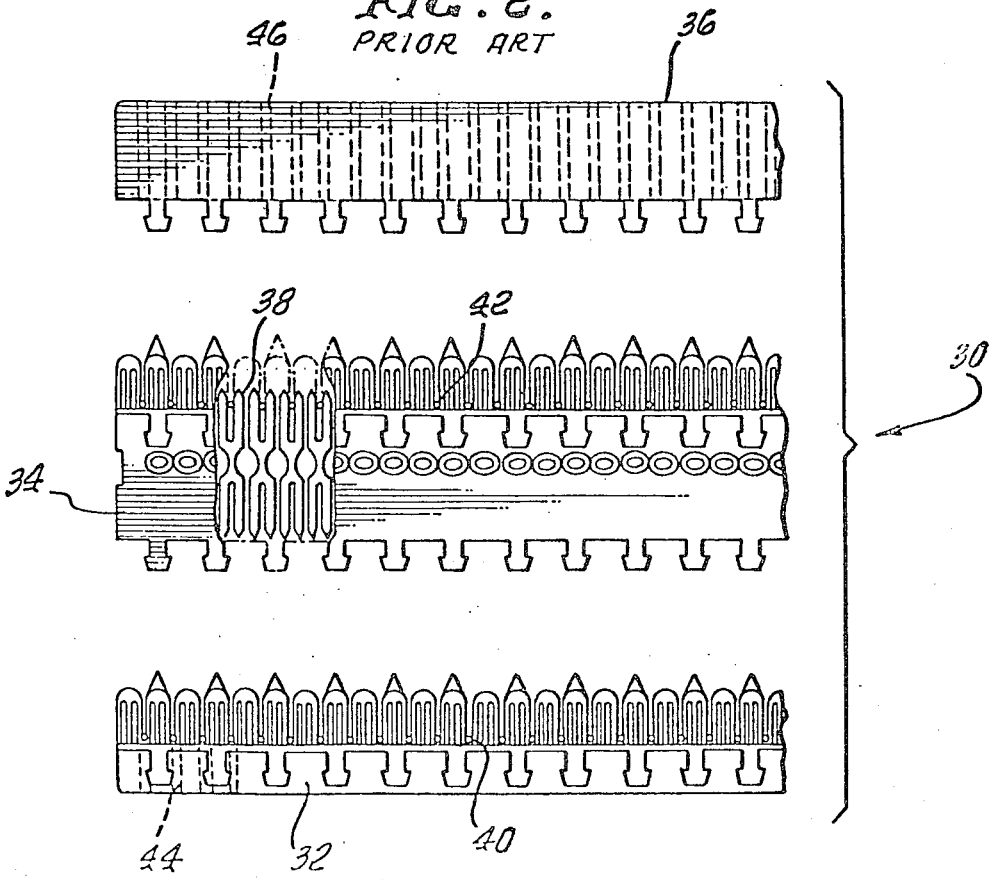
FIG. 2. PRIOR ART
FIG. 2 is an exploded elevational view, partially in section, showing the components of the connector illustrated in FIG. 1.

Referring initially to FIGS. 1 and 2 of the drawings in particular, illustrated fragmentarily therein is a connector 30 having substantially the structure fully disclosed in the aforementioned Frey et al patent, thereby making it unnecessary to describe the connector 30 in detail herein. Briefly, the connector 30 includes an index strip 32, a connector module 34 and a connector-module cap 36. The connector module 34 carries plural contacts 38 capable of receiving conductors 40 extending into the index strip 32 and conductors 42 extending into the connector module 34. The index strip 32 is provided with access holes 44 for access to the conductors 40, and the connector-module cap 36 is provided with access holes 46 for access to the conductors 42.

Figure 14:
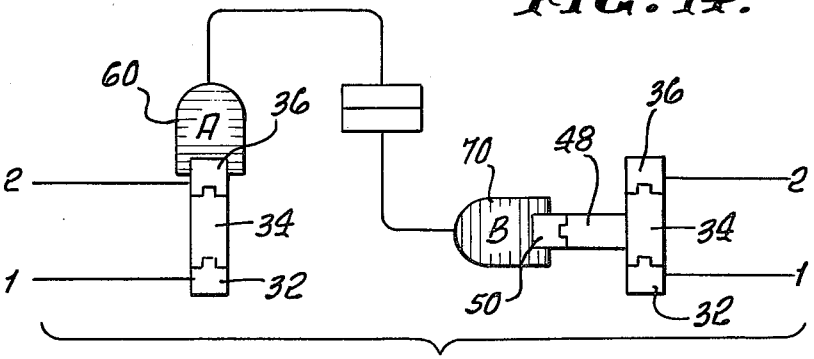
FIG. 14 is a diagrammatic view schematically showing the connector-module cap shoe in its operative relation with the index strip, connector module and connector-module cap of a connector, and showing the bridge-module cap shoe of the invention in its operative relation with the bridge module and the bridge-module cap of a second connector.
Figure 13:
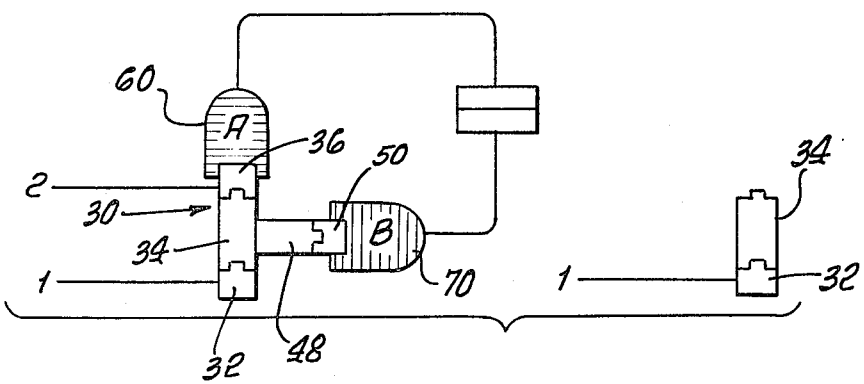
FIG. 13 is a diagrammatic view schematically showing the connector-module cap shoe and the bridge-module cap shoe of the invention in their respective operative relationships with the corresponding components of a connector.

Completing the aforementioned brief description of the connector 30, it may also include, as best shown in FIGS. 13 and 14, a bridge module 48 having a bridge-module cap 50 and adapted to accommodate a plurality of conductors. As fully disclosed in the aforementioned Frey et al. patent, the bridge-module conductors engage contacts in the bridge module 48 similar to the contacts 38 hereinbefore mentioned, and, as also shown in the Frey et al patent, the bridge module 48 and bridge-module cap 50 may be assembled with the index strip 32, the connector module 34 and the connector-module cap 36 of the connector 30 to establish electrical interconnection between the bridge-module conductors and the conductors 40 and/or 42. Consequently, a detailed description herein is not necessary. The bridge-module cap 50 is also provided with access holes for access to the bridge-module conductors.

Considering the present invention generally now, it includes a connector-module cap shoe 60, FIGS. 3–11, for making electrical connections between conductors in a cable 62 and the respective conductors 40 through the access holes 44, or the respective conductors 42 through the access holes 46, depending on the position of the connector 30 relative to the connector-module cap shoe 60. For convenience hereinafter, the connector-module cap shoe 60 will be considered only in conjunction with access to the conductors 42 through the access holes 46 in the connector-module cap 36.

Figure 12:
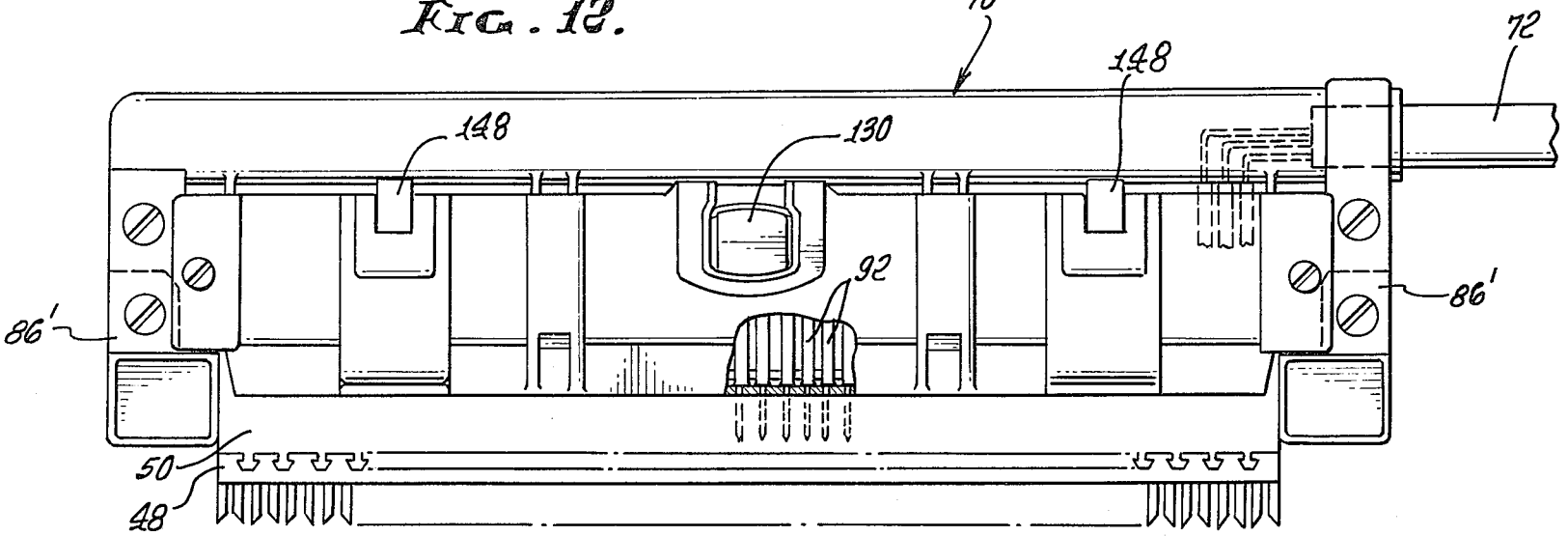
FIG. 12 is an elevational view similar to FIG. 4, but showing the bridge-module cap shoe of the invention and a bridge module of the connector in operative relationship.

Completing a general description of the invention, it also includes a bridge-module cap shoe 70, FIG. 12, for making electrical connections between conductors in a cable 72 and the bridge-module conductors through the corresponding access holes. The bridge module cap shoe 70 will be described in detail in a subsequent section of this specification.

Referring now to the connector-module cap shoe 60, as shown in FIGS. 3–11, the cap shoe has a body 80 formed of front and rear molded shell sections 81, 82, respectively. The shell sections 81, 82 are joined by screws 83 and nuts 84 positioned at each end of the sections. Grooves 85 are provided at each end of the assembled sections, for sliding the receiving arms 86, with the arms being held in place by screws 87 and corresponding nuts (not shown).

The molded shell sections 81, 82 of the cap shoe body 80 provide a generally cylindrical cavity 90 along the upper edge of the body for receiving the cable 62 and the conductors of the cable which are connected to housings 92 which carry contact pins 93. The contact pin units may be conventional in design, and typically each comprises a tubular housing 92 with an annular groove 94, with a spring within the housing acting on the pin 93, urging the pin outward. (See FIGS. 7 and 8).

Means are provided within the rear body shell section 82 for retaining and positioning the contact pin units. A horizontal rib 95 has a plurality of notches 96 for receiving the conductors 91. A plurality of bosses 97 project inward from the wall of the section 82. Another plurality of bosses 98 project inwardly from the wall of the section 82. Another rib 99 with notches 100 projects inward from the wall of the section 82. The bosses, ribs, and notches are dimensioned so that the contact pin housings 92 may be pressed into the spaces or channels between the bosses, with the bosses 97 engaging the housings 92 at the annular grooves 94. With this configuration, the cable 62 may have the contact pin units connected to its conductors 91, after which the cable is laid into the rear shell section 82 and the contact pin units are positioned side by side in the spaces. Then the front shell section is laid over the rear shell section and the two are joined together, completing the assembly of the body. Ribs 102, 103 may be provided on the interior of the front shell section 81 for maintaining the contact pin units in the channel provided by the rear shell section.

The arms 86 are then installed as previously described. In the embodiment shown in FIGS. 3–11, each of the arms 86 carries a retainer pin 106 which slides laterally in the arm and which includes a knob 107 providing for ease of manipulation.

Figure 3:
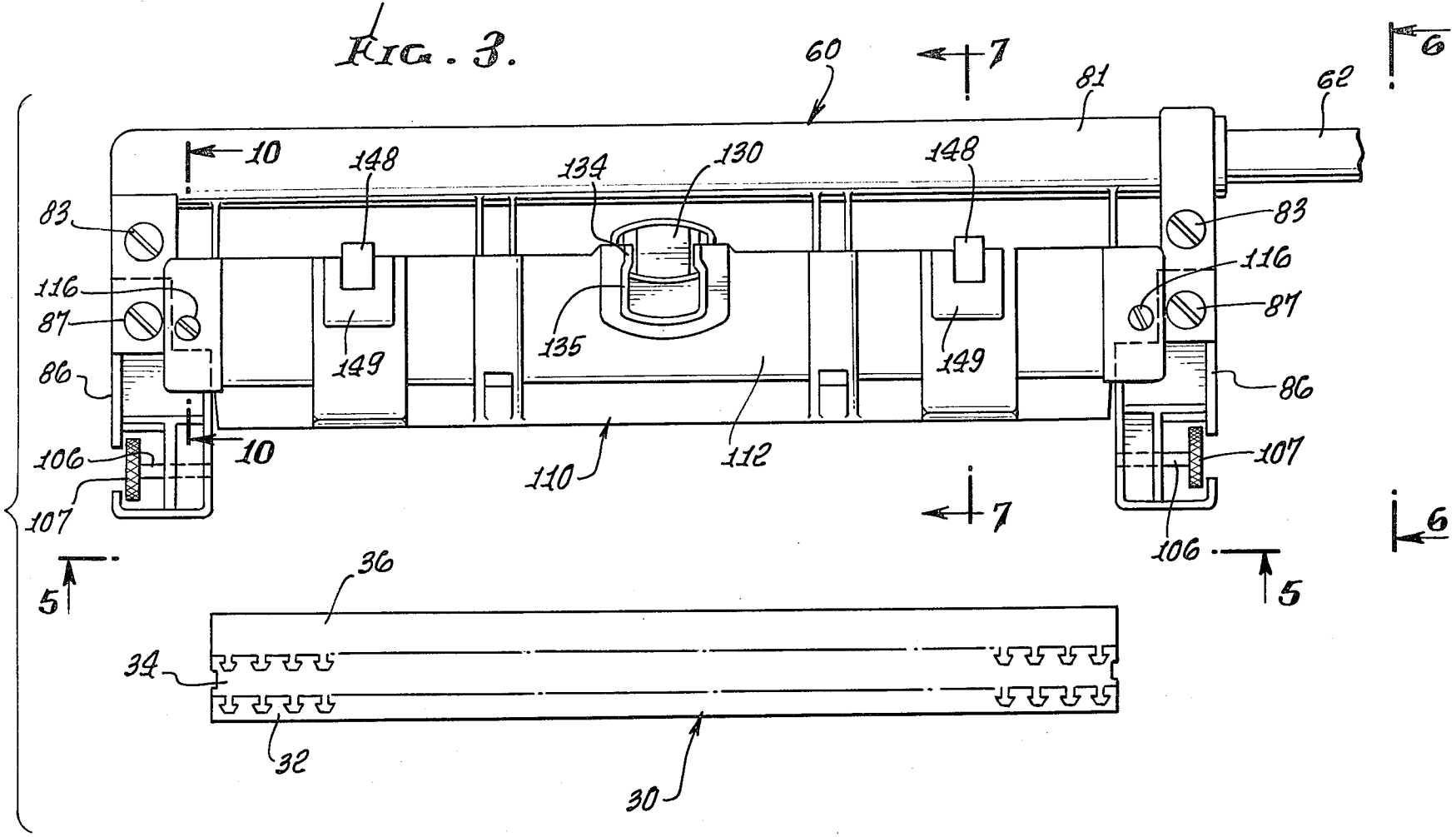
FIG. 3 is an exploded elevational view showing a connector-module cap shoe of the invention and the connector with which it is to be used.
Figure 4:
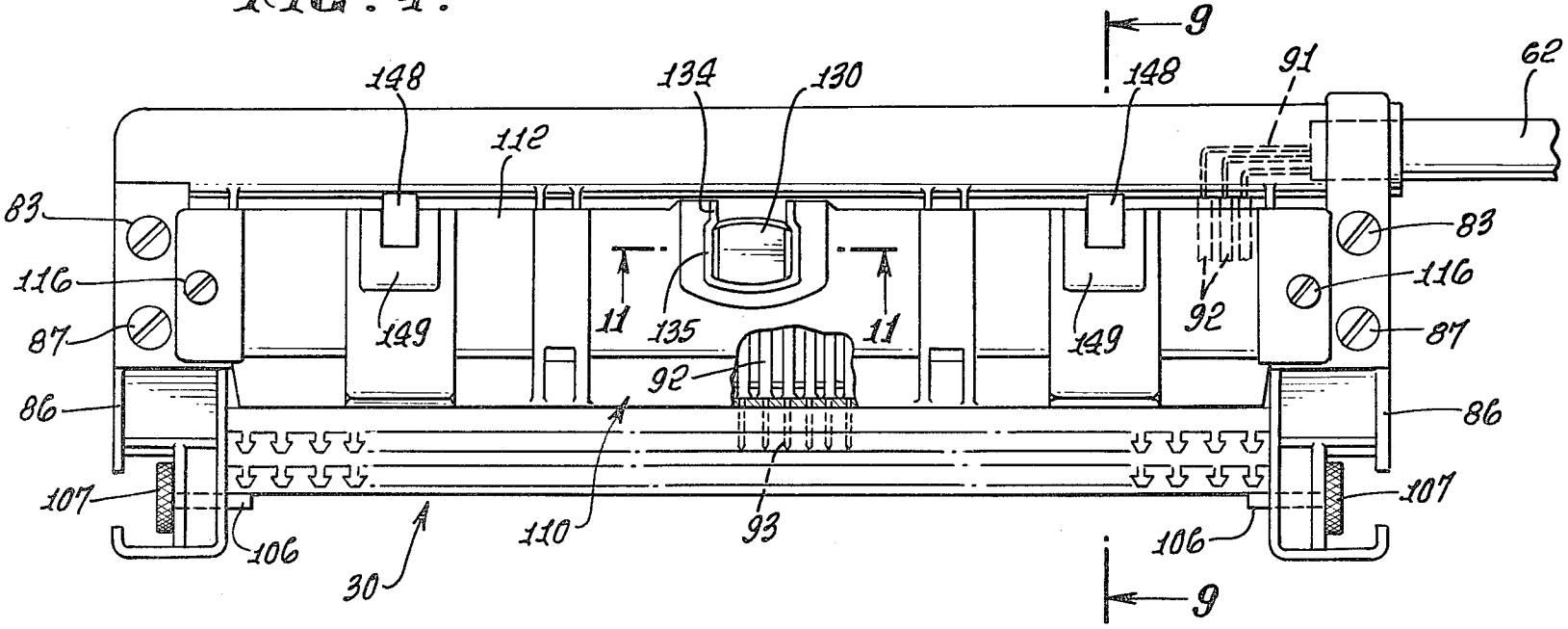
FIG. 4 is an elevational view similar to FIG. 3, but showing the connector-module cap shoe and the corresponding connector in their operative relationship.
Figure 5:
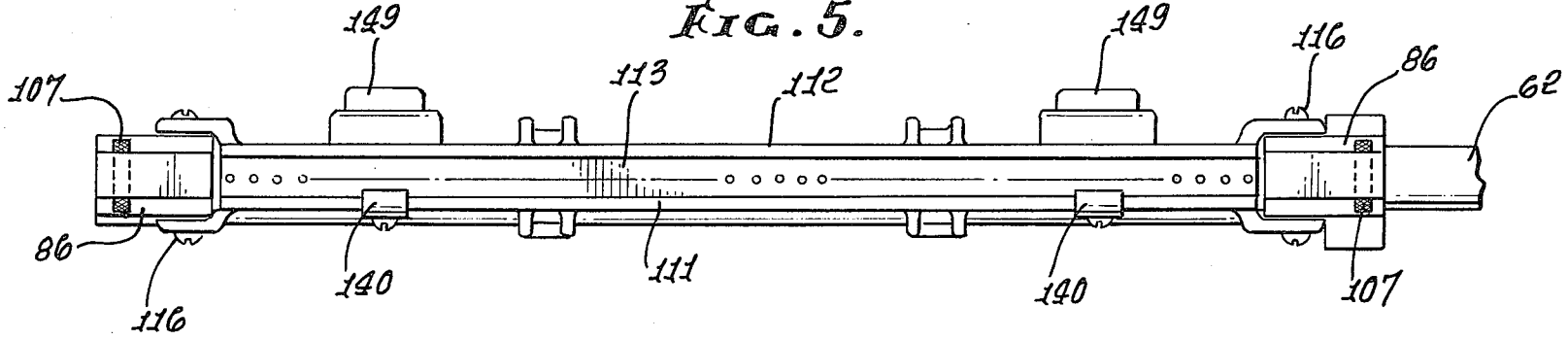
FIG. 5 is a bottom view taken as indicated by the arrowed line 5—5 of FIG. 3.

The cap shoe includes a slide member 110 having arms 111 and 112 joined by a spacer 113, which spacer has openings 114 for the pins 93 of the contact pin units. The slide member 110 also is a plastic molding, and slides on the cap shoe body 80 between the extended position shown in FIG. 3 and the retracted position shown in FIG. 4. The slide member is held in place by screws 116 which threadedly engage opposing ends of a pin 117, with the pin sliding in slots 118, 119 in the body shell sections 82, 81, respectively (See FIG. 10). A spring 120 is positioned within a cavity 121 between the two body shell sections and engages the pin 117, urging the slide member downward toward the extended position of FIG. 3. Such a spring and connection assembly is provided at each end of the cap shoe, as shown in FIG. 3.

In operation, a connector 30 is positioned between the arms 86 of the body 80, and between the arms 111, 112 of the slide member 110. The pins 93 are positioned in the openings 46 of the connector and the connector is pushed into the body, compressing the springs 120 and moving the slide member 110 from the position of FIG. 3 to the position of FIG. 4. The retainer pins 106 may then be pushed inward to hold the unit in the compressed or retracted position, with the pins 93 making electrical connection with the corresponding conductors 38 of the connector.

A latching and release button 130 may be utilized if desired (See FIG. 11.) The button 130 is positioned in a recess formed by a wall 131 of the body shell section 81. The button is urged outward by a spring 132, and is retained by a flange 133 of the arm 112 of the slide member 110. The flange 133 has a narrow section at 134 and a wide section at 135. When the slide member 110 is in the extended position as shown in FIG. 3, the button 130 is engaged by the narrow section 134 of the flange 133, holding the button in the down or spring compressed position. When the slide member 110 is moved to the compressed or retracted position of FIG. 4, the narrow portion 134 of the flange 133 is moved off the button 130 and the button is moved upward by the spring 132 to the position shown in FIG. 11. The narrow section 134 is now above the button, and the projecting button prevents downward movement of the slide member. When it is desired to release the slide member, the button is pushed downward, compressing the spring 132 and releasing the slide member. Then the springs 130 move the slide member downward.

Figure 7:
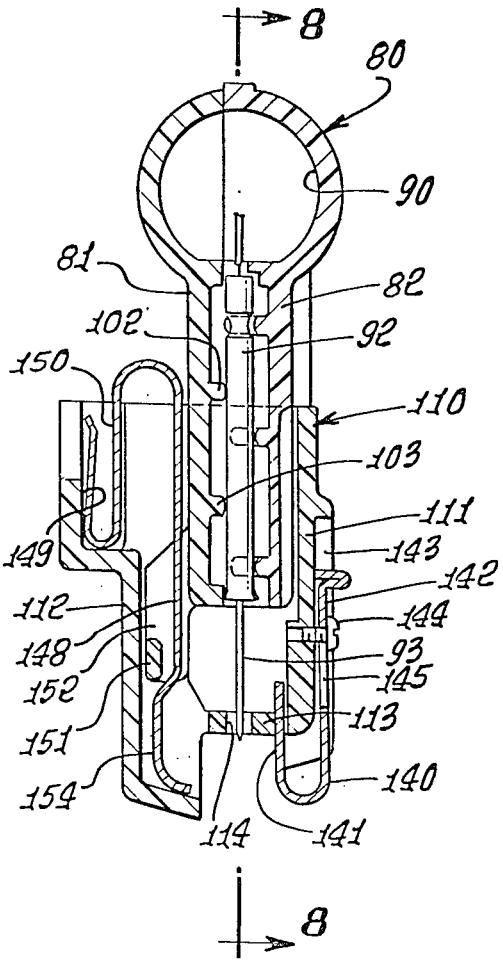
FIG. 7 is an enlarged sectional view taken as indicated by the arrowed line 7—7 of FIG. 3.
Figure 6:
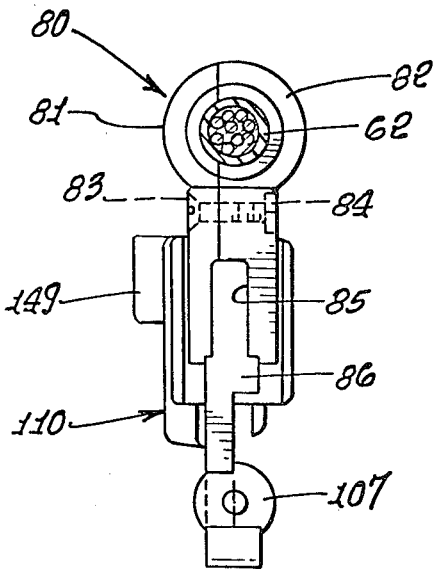
FIG. 6 is an end view, partially in section, taken as indicated by the arrowed line 6—6 of FIG. 3.
Figure 8:
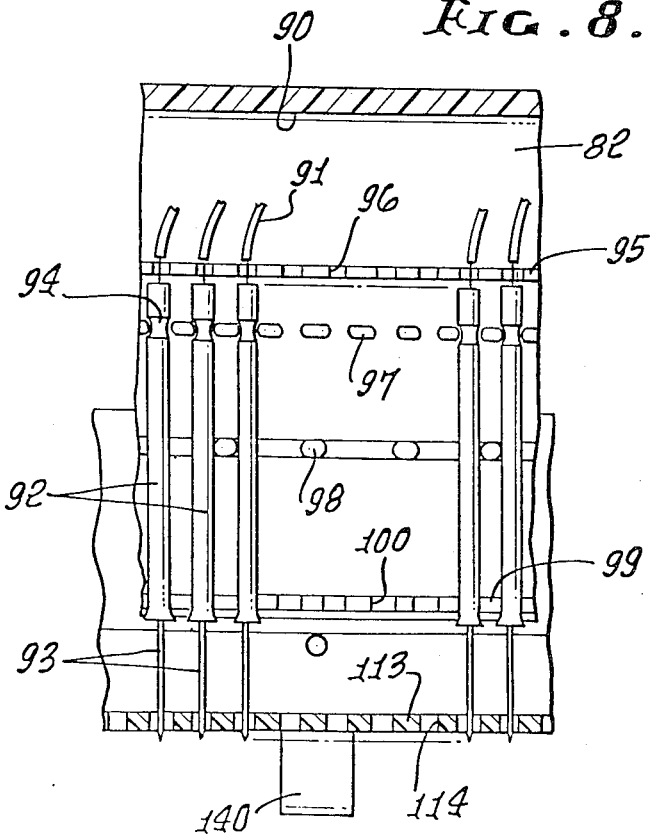
FIG. 8 is a sectional view taken as indicated by the arrowed line 8—8 of FIG. 7.

The cap shoe of the present invention is designed for operation with two sizes of connectors, which are of different thickness. Two sliding shims 140 are carried on the slide member 110 and are best seen in FIGS. 7 and 9. The shim 140 is generally U-shaped, with a free end 141 moving in a slot formed at the junction of the slide member spacer 113 and arm 111. The other arm 142 of the shim rides in a groove 143 molded in the slide member 110 and is held in place by a screw 144 which passes through a slot 145 in the shim.

The shim 140 is shown in the extended position in FIGS. 7 and 9 for use with the thin version of the connector. When the cap shoe is to be used with the thick version of the connector, the screw 144 is loosened and the shim is moved upward so that the bight of the shim is at the level of the spacer 113 and, hence, not engagable with a connector.

The cap shoe of the present invention includes an alternative means for gripping a connector in the cap shoe, in addition to the pins 106. Locking clips 148 are carried in pockets 149 molded in the slide member 110. Each of the locking clips 148 is formed of a strip of metal having some resiliency. The upper end 150 of the clip 148 is S-shaped and is designed to be a push fit into the pocket 149. A bar 151 is carried on a bracket 152 projecting outward from the body shell section 81. The lower end 154 of the locking clip passes through the space between the bar 151 and the main portion of the body section 81. The position of the locking clip when the cap shoe is in the extended position is shown in FIG. 7. When a connector 30 is positioned in the cap shoe and the slide member is moved to the retracted position, compressing the springs 120, the bar 152 is moved into the space between the lower end 154 of the clip and the pocket 149, moving the lower end of the clip to the right as seen in FIG. 9, into engagement with the connector 30. The end of the clip which engages the connector preferably is serrated or pointed to provide a grip on the connector.

In a cap shoe, the pins 106 may be used for retaining a connector in the cap shoe. Alternatively, the push button 130 and the locking clips 148 may be utilized. Or, if desired, both the pins and the push button and locking clips may be utilized.

A similar mode of operation applies when electrical connections are to be made through the access holes 44 in the index strip 32, except that the position of the connector 30 relative to the connector-module cap shoe 60 is reversed.

Bridge-Module Cap Shoe, FIG. 12

Turning now to FIG. 12 of the drawings, the bridge-module cap shoe 70 of the invention is identical to the connector-module cap shoe 60, except for the arms 86′ which are substituted for the arms 86. With the arms 86′ the cap shoe body will accommodate the bridge module 48 and its cap 50 and will permit insertion of the bridge module into a connector module.

The operation of the bridge-module cap shoe 70 is the same as that of the connector-module cap shoe 60, using the push button 130 and locking clips 148.

FIG. 13 discloses schematically how the connector-module cap shoe 60 and the bridge-module cap shoe 70 may be used simultaneously on a connector 30, with the connector-module cap shoe 60 applied to the combination of the index strip 32, the connector module 34 and the connector-module cap 36, and the bridge-module cap shoe 70 applied to the bridge module 48 and the bridge-module cap 50.

FIG. 14 shows how the connector-module cap shoe 60 may be used in conjunction with the index strip 32, or the connector-module cap 36, of one connector, while the bridge-module cap shoe 70 is used in connection with the bridge module 48 and the bridge-module cap 50 of another connector.

Although exemplary embodiments of the invention have been disclosed herein for purposes of illustration, it will be understood that various changes, modifications and substitutions may be incorporated in such embodiments without departing from the invention as hereinafter claimed.

I claim:

1. In a cap shoe for making electrical connections between a plurality of conductors in a first cable and a corresponding plurality of conductors in a connector module of an elongate strip connector which includes an index strip, the connector module, and a cap, the cap having access holes leading to the respective conductors in the connector module, the connector module including means for terminating the ends of conductors of a second cable, the combination of:

a cap shoe body of a size and shape to accommodate the connector and having an elongate central section with first and second arms projecting from opposite ends of said central section forming a first U-shaped receptacle for the connector, said cap shoe body having front and rear molded shell sections joined together at their ends, said body shell sections including means defining first and second arm grooves between said sections at each end thereof, with said first and second arms slidably insertable into said first and second arm grooves, respectively;

connector means for holding each of said arms in the corresponding groove, whereby sets of arms of different configurations can be installed and removed as desired;

releasable means for securing said cap shoe body to the connector;

a plurality of spring loaded contact pin units carried in a line along said central section of said cap shoe body between said front and rear sections, and having pins insertable through the respective access holes in the cap into electrical contact with the respective conductors in the connector module, each of said pin units including means for terminating the end of a conductor of the first cable, with said cap shoe body including means for receiving the first cable;

a second U-shaped slide member in the form of a unitary molding and mounted on said cap shoe body with the arms of said slide member embracing said body and slidable relative thereto between extended and retracted positions in a direction parallel to the axes of said contact pins, and including an integral elongate spacer between the arms of said slide member with openings in a line through which said contact pins extend; and compression spring means positioned within said cap shoe body and engaging said body and slide member urging said slide member away from said body for ejecting the connector from said body;

whereby said extending contact pins enter the access holes in the cap into electrical contact with the respective conductors in the connector module upon retraction of said slide member by sliding said cap shoe body onto the connector and compressing said spring means.

2. A cap shoe as defined in claim 1 including a shim mounted on said slide member at the edge of said spacer and slidable in a shim groove of said slide member between a first position projecting from said spacer for engaging the connector and a second position substantially flush with said spacer and out of engagement with the connector.

3. A cap shoe as defined in claim 2 wherein said shim is generally U-shaped with one arm positioned in said shim groove and with the other arm overlying said slide member and having a slot, and including means for affixing said shim to said slide member through said slot permitting movement of said shim relative to said slide member.

4. A cap shoe as defined in claim 2 including a locking clip carried in said slide member and having a connector engaging end positioned adjacent said spacer, with one of said cap shoe body shell sections including a bar positioned between said clip and slide member and engagable with said clip when said slide member is moved to said retracted position to move said clip end into engagement with the connector.

5. In a cap shoe for making electrical connections between a plurality of conductors in a first cable and a corresponding plurality of conductors in a connector module of an elongate strip connector which includes an index strip, the connector module, and a cap, the cap having access holes leading to the respective conductors in the connector module, the connector module including means for terminating the ends of conductors of a second cable, the combination of:

a cap shoe body of a size and shape to accommodate the connector and having an elongate central section with first and second arms projecting from opposite ends of said central section forming a first U-shaped receptacle for the connector, said cap shoe body having front and rear molded shell sections joined together at their ends;

releasable means for securing said cap shoe body to the connector;

a plurality of spring loaded contact pin units carried in a line along said central section of said cap shoe body between said front and rear sections, and having pins insertable through the respective access holes in the cap into electrical contact with the respective conductors in the connector module, each of said pin units including means for terminating the end of a conductor of the first cable, with said cap shoe body including means for receiving the first cable;

a second U-shaped slide member in the form of a unitary molding and mounted on said cap shoe body with the arms of said slide member embracing said body and slidable relative thereto between extended and retracted positions in a direction parallel to the axes of said contact pins, and including an integral elongate spacer between the arms of said slide member with openings in a line through which said contact pins extend;

compression spring means positioned within said cap shoe body and engaging said body and slide member urging said slide member away from said body for ejecting the connector from said body; and a shim mounted on said slide member at the edge of said spacer and slidable in a shim groove of said slide member between a first position projecting from said spacer for engaging the connector and a second position substantially flush with said spacer and out of engagement with the connector;

whereby said extending contact pins enter the access holes in the cap into electrical contact with the respective conductors in the connector module upon retraction of said slide member by sliding said cap shoe body onto the connector and compressing said spring means.

6. A cap shoe as defined in claim 5 wherein said shim is generally U-shaped with one arm positioned in said shim groove and with the other arm overlying said slide member and having a slot, and including means for affixing said shim to said slide member through said slot permitting movement of said shim relative to said slide member.

7. In a cap shoe for making electrical connections between a plurality of conductors in a first cable and a corresponding plurality of conductors in a connector module of an elongate strip connector which includes an index strip, the connector module, and a cap, the cap having access holes leading to the respective conductors in the connector module, the connector module including means for terminating the ends of conductors of a second cable, the combination of:

a cap shoe body of a size and shape to accommodate the connector and having an elongate central section with first and second arms projecting from opposite ends of said central section forming a first U-shaped receptacle for the connector, said cap shoe body having front and rear molded shell sections joined together at their ends;

releasable means for securing said cap shoe body to the connector;

a plurality of spring loaded contact pin units carried in a line along said central section of said cap shoe body between said front and rear sections, and having pins insertable through the respective access holes in the cap into electrical contact with the respective conductors in the connector module, each of said pin units including means for terminating the end of a conductor of the first cable, with said cap shoe body including means for receiving the first cable;

a second U-shaped slide member in the form of a unitary molding and mounted on said cap shoe body with the arms of said slide member embracing said body and slidable relative thereto between extended and retracted positions in a direction parallel to the axes of said contact pins, and including an integral elongate spacer between the arms of said slide member with openings in a line through which said contact pins extend;

compression spring means positioned within said cap shoe body and engaging said body and slide member urging said slide member away from said body for ejecting the connector from said body; and a locking clip carried in said slide member and having a connector engaging end positioned adjacent said spacer, with one of said cap shoe body shell sections including a bar positioned between said clip and slide member and engagable with said clip when said slide member is moved to said retracted position to move said clip end into engagement with the connector;

whereby said extending contact pins enter the access holes in the cap into electrical contact with the respective conductors in the connector module upon retraction of said slide member by sliding said cap shoe body onto the connector and compressing said spring means.

8. In a cap shoe for making electrical connections between a plurality of conductors in a first cable and a corresponding plurality of conductors in a connector module of an elongate strip connector which includes an index strip, the connector module, and a cap, the cap having access holes leading to the respective conductors in the connector module, the connector module including means for terminating the ends of conductors of a second cable, the combination of:

a cap shoe body of a size and shape to accommodate the connector and having an elongate central section with first and second arms projecting from opposite ends of said central section forming a first U-shaped receptacle for the connector, said cap shoe body having front and rear molded shell sections joined together at their ends;

releasable means for securing said cap shoe body to the connector;

a plurality of spring loaded contact pin units carried in a line along said central section of said cap shoe body between said front and rear sections, and having pins insertable through the respective access holes in the cap into electrical contact with the respective conductors in the connector module, each of said pin units including means for terminating the end of a conductor of the first cable, with said cap shoe body including means for receiving the first cable, each of said contact pin units including an elongate cylindrical tubular housing with a contact pin therein, with said housing having an annular groove, with one of said body shell sections including a plurality of sets of inwardly projecting spaced bosses with adjacent bosses of each set defining parallel channels for receiving said pin unit housings, with the bosses of one of said sets larger than the bosses of the other sets and positioned to engage said housings at said annular grooves for limiting axial movement of said housings, and with the other of said body shell sections including inwardly projecting ribs dimensioned to engage said pin unit housings with said body shell sections and joined together for retaining said housings in the respective channels;

a second U-shaped slide member in the form of a unitary molding and mounted on said cap shoe body with the arms of said slide member embracing said body and slidable relative thereto between extended and retracted positions in a direction parallel to the axes of said contact pins, and including an integral elongate spacer between the arms of said slide member with openings in a line through which said contact pins extend; and compression spring means positioned within said cap shoe body and engaging said body and slide member urging said slide member away from said body for ejecting the connector from said body;

whereby said extending contact pins enter the access holes in the cap into electrical contact with the respective conductors in the connector module upon retraction of said slide member by sliding said cap shoe body onto the connector and compressing said spring means.

* * * * *